US009718571B1

(12) United States Patent
Busboom

(10) Patent No.: US 9,718,571 B1
(45) Date of Patent: Aug. 1, 2017

(54) YARD WASTE COLLECTION DEVICE

(71) Applicant: John Busboom, Campbell, CA (US)

(72) Inventor: John Busboom, Campbell, CA (US)

( * ) Notice: Subject to any disclaimer, the term of this patent is extended or adjusted under 35 U.S.C. 154(b) by 0 days.

(21) Appl. No.: 14/990,553

(22) Filed: Jan. 7, 2016

Related U.S. Application Data

(60) Provisional application No. 62/100,861, filed on Jan. 7, 2015.

(51) Int. Cl.
*B65B 67/04* (2006.01)

(52) U.S. Cl.
CPC ..... *B65B 67/04* (2013.01)

(58) Field of Classification Search
CPC ..... B65B 67/04
USPC ..... 141/114, 313, 363–366, 391
See application file for complete search history.

(56) References Cited

U.S. PATENT DOCUMENTS 3,312,263 A 4/1967 Wahlstrom
3,833,249 A * 9/1974 McKinney, II ..... A47L 13/52 15/104.8
3,936,087 A * 2/1976 Alexander ..... A47L 13/52 141/103
4,312,531 A * 1/1982 Cross ..... E01H 1/12 141/108
4,434,829 A 3/1984 Barnard
4,686,734 A * 8/1987 Alexander ..... A47L 13/52 15/257.1
4,854,003 A 8/1989 Roberts
5,020,184 A * 6/1991 Roberts ..... B65B 67/1238 15/257.5
5,088,531 A 2/1992 Wade
5,104,133 A * 4/1992 Reiner ..... B62B 15/00 280/19
5,365,632 A 11/1994 Kirchnavy
5,709,477 A * 1/1998 Schinasi ..... A01G 1/12 15/257.6
5,722,220 A * 3/1998 Greenland ..... A01D 51/00 229/87.01
5,878,461 A 3/1999 Killian
5,915,768 A * 6/1999 Young ..... B65B 67/12 15/257.1
6,202,718 B1 * 3/2001 Innocenti ..... B65D 71/30 141/391
6,446,918 B1 * 9/2002 Knight ..... B65B 67/04 248/101
6,938,860 B2 * 9/2005 Singleton ..... B65F 1/00 141/390
6,953,213 B2 * 10/2005 Yardley ..... A01B 1/00 294/152
7,093,867 B2 * 8/2006 Yardley ..... A01G 1/12 294/152

(Continued)

*Primary Examiner* — Nicolas A Arnett
(74) *Attorney, Agent, or Firm* — Thomas M. Freiburger

(57) ABSTRACT

A yard waste collection and carrying device is in the form of a large flat-bottomed tray open at one end, sized to receive leaves, sticks and other materials raked into the open end. Formed of a semi-rigid rubbery plastic material, the device stores a large volume of material, has a pair of opposed side handles for carrying, and is easily deformed to curve the forward end into a pouring configuration, so that the collected materials can easily be transferred into a narrower waste can. The shape of the device is such as to be compactly stackable for storing or shipping a number of the devices together.

21 Claims, 3 Drawing Sheets

(56) References Cited

U.S. PATENT DOCUMENTS

| | | | | |
|---|---|---|---|---|
| 7,270,160 | B1 * | 9/2007 | Harris, Jr. | B08B 17/00 141/114 |
| 7,367,600 | B1 | 5/2008 | Lew et al. | |
| 7,520,546 | B2 * | 4/2009 | Monahan | A01G 1/125 15/257.1 |
| D641,529 | S * | 7/2011 | Suh | D34/1 |
| 8,181,569 | B1 * | 5/2012 | Lewandowski | B30B 9/301 100/102 |
| 8,684,429 | B1 | 4/2014 | Holub | |
| 9,422,107 | B1 * | 8/2016 | Sigety | B65F 1/0006 |
| 9,475,614 | B2 * | 10/2016 | Rittenour | A45C 3/001 |
| 2004/0212201 | A1 * | 10/2004 | Esposito | B65F 1/00 294/214 |
| 2006/0261616 | A1 * | 11/2006 | Weathers | B65B 67/04 294/51 |
| 2011/0277883 | A1 | 11/2011 | Noonan | |

* cited by examiner

YARD WASTE COLLECTION DEVICE

This application claims benefit of provisional application Ser. No. 62/100,861, filed Jan. 7, 2015.

BACKGROUND OF THE INVENTION

This invention concerns collection of yard waste, and in particular is directed to a yard debris collection device which is large enough to receive and store leaves, bark, sticks and small branches raked into the device and with provision for conveniently carrying the device and dumping the contents into a trash can.

Dust pans have been in use for many years, to receive dirt, dust and other debris swept into the dust pan with a broom, from a flat floor. The dust pan has a rigid body and can be used to dump material into a trash container, provided the trash container has a wide enough opening. Flat-ended shovels can be used for the same purpose, as well as for use in actively scooping debris from a surface without use of a broom.

In cleaning a lawn or yard of fallen leaves, sticks, small branches or other debris, there has been no efficient and effective way to gather such debris and transfer it to one or more trash cans. Something like a very large dust pan would be a possibility, but would be unwieldy to carry, with an inconvenient handle, and not conducive to transferring collected debris into a trash can, such as a 30 gallon container.

Larger collection devices have been suggested for this purpose, as described in the following U.S. patents and applications: U.S. Pat. Nos. 3,312,263, 4,434,829, 4,854,003, 5,088,531, 5,365,632, 5,878,461, 7,367,600, 8,684,429 and Pub. No. 2011/0277883. Some of these patent documents address the need for a carryable or draggable receptacle, and/or one whose shape can be changed by the user in order to provide a scoop-shaped front end for effective delivery of debris into a relatively narrow-mouthed trash can. See, e.g. the above U.S. Pat. Nos. 5,878,461, 7,367,600, 3,312,263, 4,434,829 and Pub. No. 2011/0277883. None of the devices described in these documents has combined features of ideal size and width for raking, carrying and storage, with optimum flexibility for bending the forward end into a pouring configuration while still providing sufficient stiffness for receiving heavy materials, and provision of handles of optimum configuration and position on the device for comfortable and convenient carrying. These are objects of the current invention described below.

SUMMARY OF THE INVENTION

The invention provides a yard debris collection, carrying and disposal device which combines optimal features as noted above. The device has a plastic body generally shaped as a tray with a bottom and side and back walls, open at the front, and with a width of about 30 inches (plus or minus 3 inches). The side and back walls extend up from the bottom to adequate height to retain a large mass of collected debris, as much as can be conveniently carried. The sides rise essentially squarely from the bottom near the open front end of the device, but are curved at bottom, both vertically and horizontally, at and near rear corners. This roundness assists in the flexibility of the debris collecting device, for deliberately deforming the front end into a scoop or pouring trough, without significant deformation of the side and rear walls, in order to dump the collected debris into a can or receptacle of relatively narrow opening. The curvature at the rear bottom corners also makes for more comfort while carrying or emptying without sharp corners against arms or elbows.

The body is molded from a plastic or rubbery plastic material, and this can be a low density polyethylene (LDPE) or a linear low density polyethylene (LLDPE), or an appropriate form of polyurethane. Preferably injection molded, the body's side and back walls are angled slightly outwardly/upwardly. The material thickness of the body depends on the material itself, but is essentially about ⅛ inch to 3/16 inch, and thickness can vary in different portions of the body. The front debris-collecting edge of the bottom preferably is tapered to a somewhat lesser thickness than other regions of the bottom for receiving raked-in debris, and the side walls and back wall, being integrally connected together at back corners, have strength from this connection and can be somewhat thinner than other regions. If desired the bottom side can be ribbed if desired (such as in the lengthwise direction) for resistance against bending along a transverse axis.

In one preferred embodiment the material of the body is of such stiffness and thickness that the device, the front end in particular, has a bendability (elastic, without permanent deformation) that can be quantified as about 3-4 inches of downward deformation at center front by application of 5 to 8 pounds of inward squeezing force at the side handles; or, about 3-5 inches of downward deformation at center front with a total inward force of 4-10 pounds. At the same time, the bottom returns to flat condition and is sufficiently stiff and strong in use on a yard or lawn that relatively heavy materials can be raked or placed into the device without objectionable deformation of the bottom or walls.

An important feature of the debris collecting device is the inclusion of left and right side handles, and their configuration and positioning. Although the sides could have U-shaped handles extending outwardly or simply holes (reinforced) through the sides, it is preferred that the handles are designed for comfort in carrying the debris-loaded device. The handles preferably comprise inserts into which the fingers of the user can extend, similar to handles on some plastic storage bins.

Location of the handles is also important. The collection device is deeper (higher walls, e.g. 8-10 inches, preferably about 8 to 9 inches) at the back and thus will normally be heavier toward the back when loaded. The handles preferably are located toward the back, spaced from the back end by about 25% to about 40% of the length of the collection device. In addition to generally balancing the weight on the handles, this also makes the loaded collection device comfortable for a user to carry with the front edge of the device facing forward.

In addition to yard debris the collection device can be used to receive, carry and dump heavy materials such as sand, plaster, construction materials or demolition debris.

It is among the objects of the invention to improve over all previous yard debris collection implements with a collection device of ideal size, with conveniently used handles for carrying the loaded device, and with optimum flexibility so that the device is sufficiently stiff to receive light and heavy objects raked in, but flexible enough that the bottom can be formed into a pouring trough without requiring excessive force, so that debris can be easily transferred to a trash container. These and other objects, advantages and features of the invention will be apparent from the following description of a preferred embodiment, considered along with the accompanying drawings.

DESCRIPTION OF PREFERRED EMBODIMENTS

Figure 1:
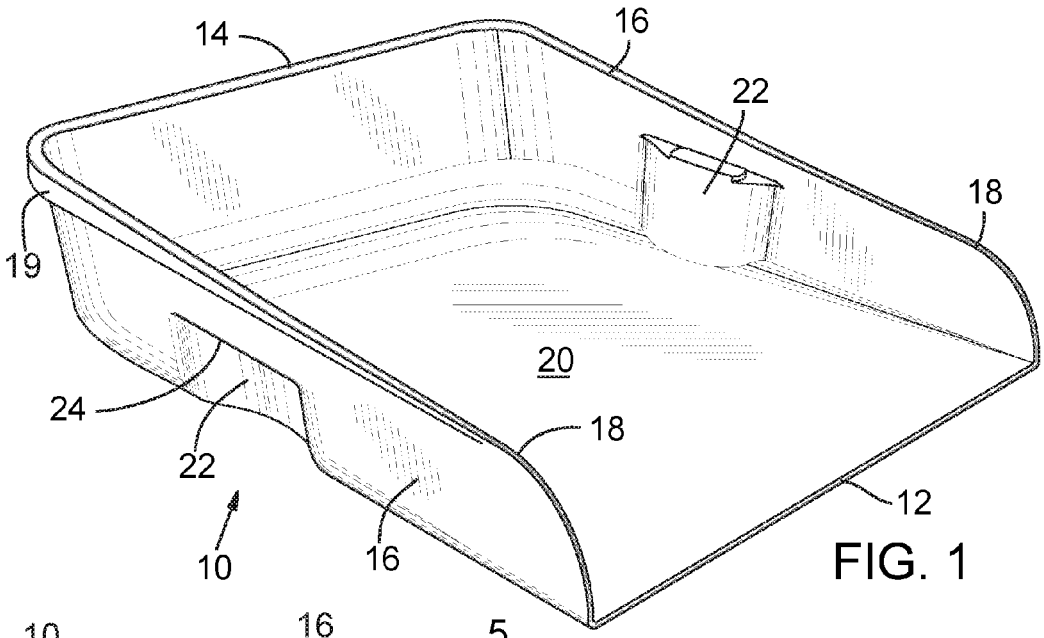
FIG. 1 is a perspective view showing a yard debris collection device according to the invention.
Figure 2:
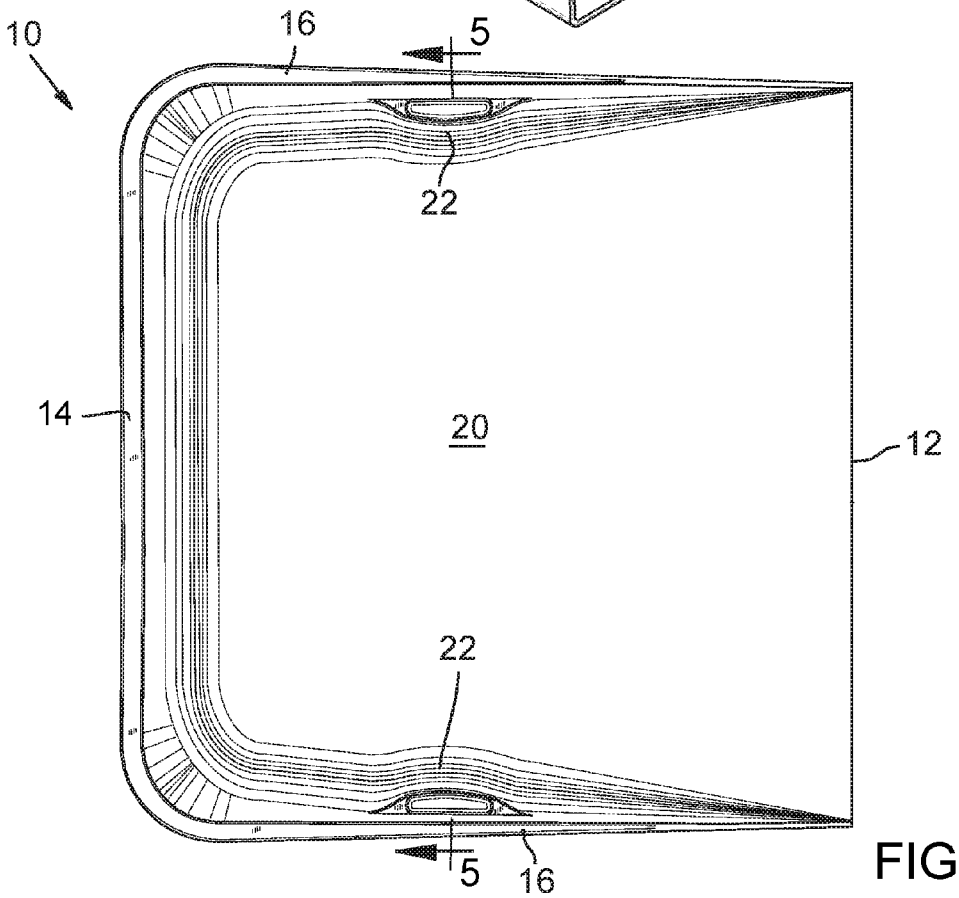
FIG. 2 is a top plan view showing the device.

FIG. 1 shows a debris collection device 10 of the invention, in a preferred embodiment. The device is molded, preferably by injection molding, of a semi-rigid plastic such as a polyethylene, polypropylene or polyurethane as noted above. One preferred material is LDPE. The storage capacity of the collection implement is ample for yard work and for collection of and carrying of a substantial volume of debris, or other materials which can be fairly heavy, such as construction material or demolition debris. Its preferred dimensions are about 26 to 35 inches overall from front to back, more preferably 29 to 32 inches, and most preferably about 31 inches; about 28 to 32 wide inches at the front end or mouth 12, preferably about 30 inches, with an overall width (at handles) of about 32 inches; and with a back wall 14 of about 8 to 10 inches height (preferably 8 to 9 inches) and side walls 16 that meet the back wall 14 at equal height and taper down to about 4 to 6 inches (preferably about 5 inches) at shoulders 18 where the tapered sides drop more steeply down to the front edge or mouth 12, preferably on a curve as shown, which can be on a radius of about 5 inches. The top edge of the back and most of the length of the side walls is formed into a rolled over lip 19 as shown in the drawings.

As shown in FIGS. 1 through 5, the bottom 20 of the collection implement is flat or substantially flat, so as to lie essentially flatly on a surface to enable debris to be raked in from the open front or otherwise loaded into the device. The open front edge 12 of the implement is sized to receive material raked by a leaf rake, which typically can be about 30 inches in width. When the interior of the implement is fully loaded, especially with wet material, the total weight will be approaching that which can be comfortably carried.

Figure 5:
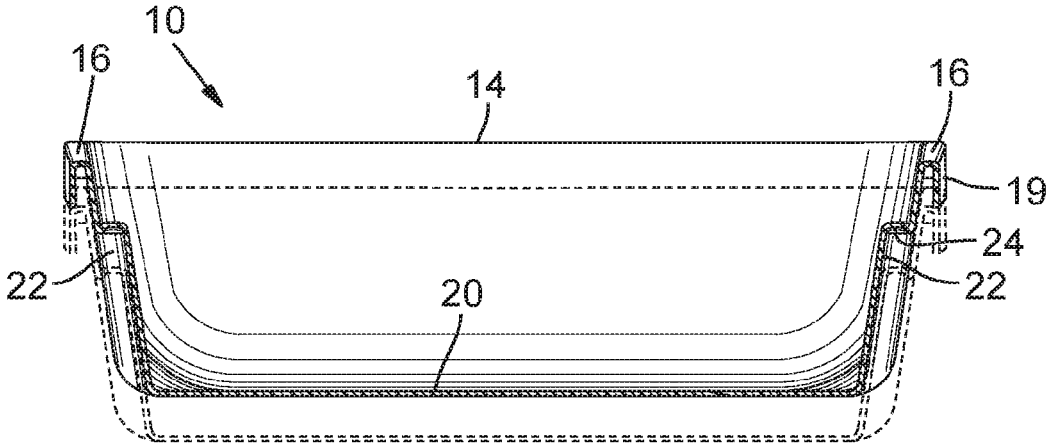
FIG. 5 is a transverse section view in elevation, showing the collection device stacked with a second such device.

The side and back walls of the implement 10 preferably angle outwardly/upwardly somewhat, as shown in FIGS. 1-5. This allows for compact stacking, as shown in FIG. 5, more comfortable and secure carrying, and also is better for molding of the device. In addition, this configuration increases the volume capacity somewhat.

The device when loaded with debris approximately to the upper edges of the sides and back will hold almost 4 cubic feet of material; a preferred range is about 3 to 4 cubic feet. Of course, materials such as yard rakings can be piled in the implement higher than the top edges; for soil or other heavy, dense material a practical limit will be about one or two cubic feet for carrying.

Figure 3:
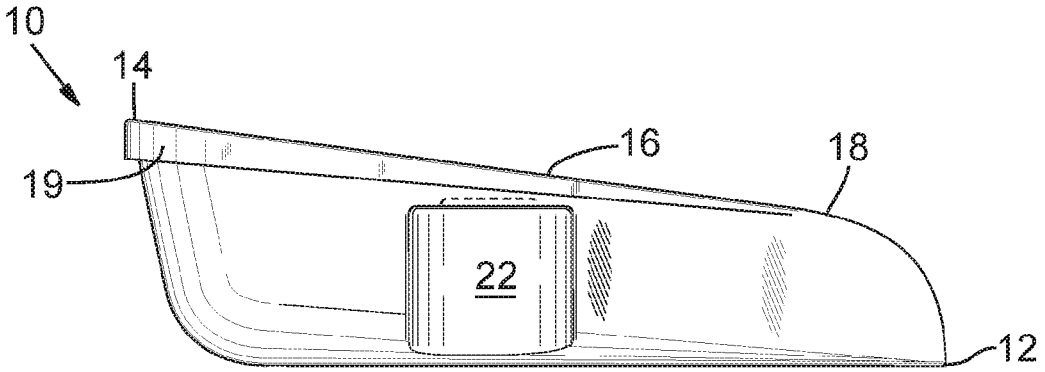
FIG. 3 is a side elevation view showing a preferred form of handle in a side wall of the device.
Figure 4:
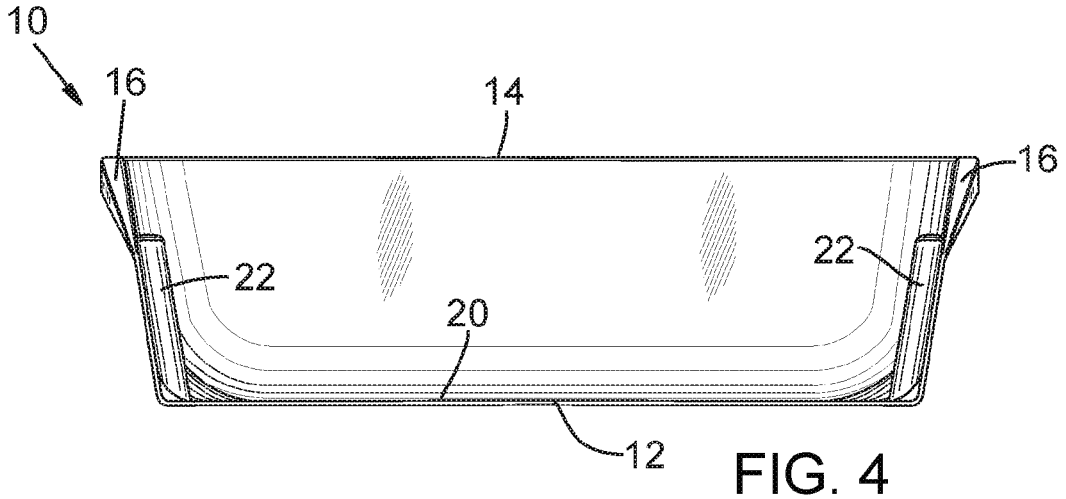
FIG. 4 is a front elevation view of the device.

The upper edges of the rear and side walls 14 and 16 have some form of reinforcement so as to strengthen and also soften these edges, and this preferably is accomplished with the folded over lip or rollover 19 as shown particularly in FIGS. 1, 3 and 5. As discussed above, handles 22 are included in the side walls. Although these could be simply U-shaped outwardly extending loops, or simply reinforced, elongated holes or slots through the sides, the handles are advantageously formed as indentations as shown in the drawings, and positioned for approximate load balancing and for comfort in carrying. As shown, the indented handles smoothly transition from the sides, forming a ledge 24 under which the fingers of the user engage. The indented finger pocket may be about 4 to 5 inches long, with the ledge 24 being about 1 to 1½ inch below the top edge of the side wall (top of rollover 19). Depth of the finger pocket (in from the outside of the side wall at top center of handle) can be about ¾ inch to 2 inches, preferably about ¾ inch to 1½ inch. These handle indentations 22 are formed so as to be compatible with stackability (FIG. 5), and the indentation should extend in somewhat more at bottom of the handle for stackable nesting. The position of the handles (at center) is preferably about one third of the distance forward from the back wall 14, or more generally, about 25% to 40% of the overall length, forward from the back wall.

Figure 7:
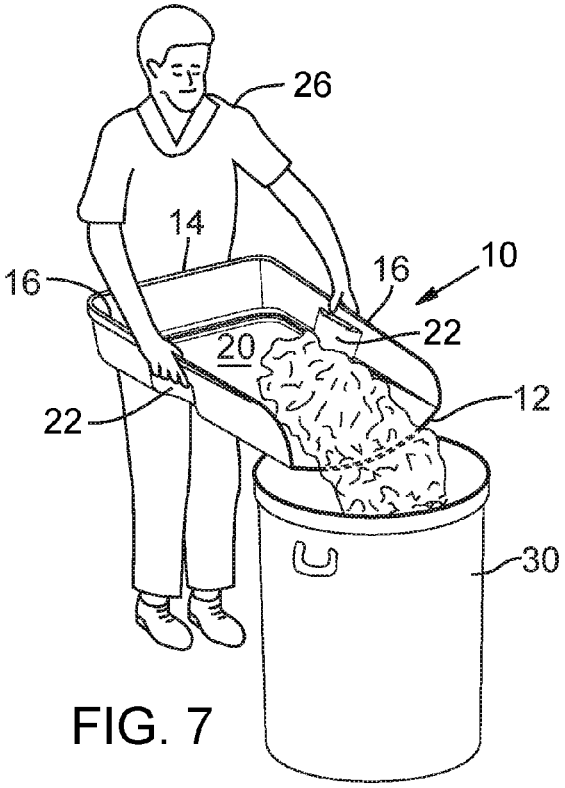
FIG. 7 is a view showing the collection device being carried and forced into a deformed configuration in which the front is curved into a pouring trough for transfer of collected material into a trash can.

FIG. 7 shows a worker 26 carrying the debris collection implement 10, and in this instance, pouring the collected debris into a trash can 30. With the handles 22 closer to the back than the front of the implement, the user 26 can more comfortably carry the loaded device against his body. Specifically, the handles at centers should not be more than about 11 inches forward of the rear of the device, because only significantly greater distance can cause back strain to the user when carrying.

As explained above, an important feature of the debris collection device of the invention is that it can conveniently be deformed into a trough or pouring configuration for dumping debris into a can, as shown in FIG. 7. The somewhat rubbery plastic material, although semi-rigid when in use as in FIG. 6, can be deformed by squeezing inwardly at the handles to form a trough shape at the pouring end 12. For example, the front edge 12 can be deflected such that its center is lowered by about 3-5 inches from normal planar configuration, requiring an inward force at the handles no greater than about 4 to 10 pounds. More preferably, that center front edge deflection is about 3-5 inches (preferably about 4 inches) with about 5 pounds inward force, or about 4-5 inches (preferably about 4½ inches) with about 8 pounds force, or about 5 inches with about 10 pounds force.

The material of the yard waste implement in a preferred embodiment has a flexural modulus of about 42,000 to 50,000 psi (by ASTM D-790), more preferably about 45,000 to 48,000 psi.

Figure 6:
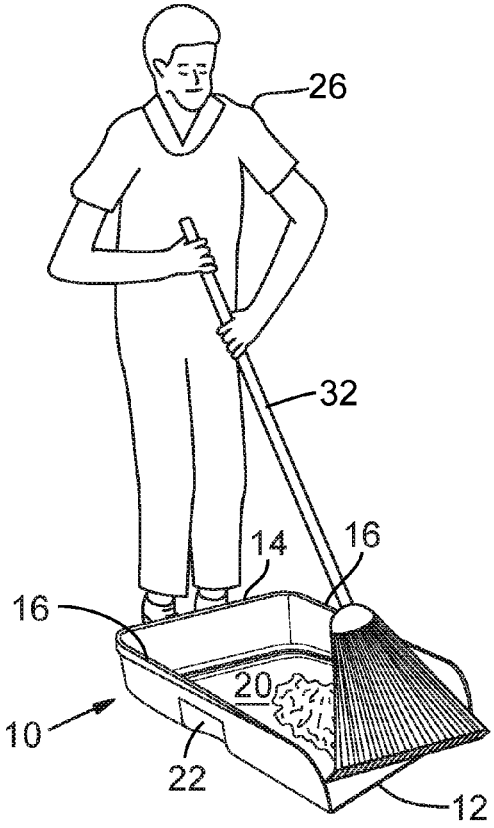
FIG. 6 is a perspective view showing leaves and other yard debris being raked into the collection device of the invention.

FIG. 6 shows the worker 26 using a leaf rake 32 to move debris into the implement 10 of the invention. The width of the device 10 is sufficient to receive materials drawn in by the rake 32. Loading of the device can be done by standing behind the back 14 of the device with a foot on the ground braced against the back end, so that debris can be pulled inwardly with the rake. The worker could also stand at one side of the device while raking.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A device for collecting yard waste and other loose materials, then transferring the materials to a trash can or other waste receptacle, comprising:

a generally tray-shaped body of plastic material, having a substantially flat bottom and a rear wall and two side walls extending up from the bottom, the body having a front edge substantially linear, configured to lie flatly on a yard or other surface such that leaves and other debris lying on the surface can be raked into the device, the front edge, between the two side walls, being at least about 28 inches wide, the rear wall being at least about 8 inches high from the bottom, and the side walls tapering from where meeting the rear wall down to about 3-6 inches near the front end of the device, the body being formed of a flexible plastic material such that the front edge is bendable by pressing inward on the sides of the body, from a linear configuration to a curved configuration wherein the center of the front edge dips downwardly 3-5 inches with a total inward force on the sides of about 4-10 pounds, to facilitate pouring loose materials from the device into a narrow waste receptacle, a pair of handles at left and right on the side walls, the handles being positioned closer to the rear wall of the body than to the front edge, and the body having an overall length from front to rear in the range of about 26 inches to 35 inches.

2. The device of claim 1, wherein the bottom meets the sides at a sharp corner at left and right at the front of the device, but with a curving transition between the bottom and sides near the back wall, and with a curving transition with the back wall.

3. The device of claim 1, wherein the rear wall is about 8 to 9 inches tall.

4. The device of claim 1, wherein the width of the bottom at the front edge, between two side walls, is about 30 inches.

5. The device of claim 1, wherein the front edge dips downwardly about 4 inches with a total inward force on the sides, at the handles, of about 5 pounds.

6. The device of claim 1, wherein the front edge dips downwardly about 4½ inches with a total inward force on the sides, at the handles, of about 8 pounds.

7. The device of claim 1, wherein the front edge dips downwardly about 5 inches with a total inward force on the sides, at the handles, of about 10 pounds.

8. The device of claim 1, wherein the side walls taper from where meeting the rear wall down to about 4½ to 5½ inches near the front end of the device, then descending on about a 5 inch radius to the front edge.

9. The device of claim 1, wherein the handles are positioned at locations about 35% of the body's length from the inside surface of the back wall of the body.

10. The device of claim 1, wherein the length of the body from front to back is about 30 to 32 inches, and the handles are positioned about 11 inches forward from the inside surface of the back wall.

11. The device of claim 1, wherein the handles extend inwardly and integrally in the side walls to provide pockets into which a user's fingers can be placed to grip the handles.

12. The device of claim 11, wherein the handles extend inwardly from the side walls, at top center of the pockets, by about ¾ to 1½ inches.

13. The device of claim 11, wherein the handles are configured to provide a light locking force between adjacent devices when the devices are stacked.

14. The device of claim 1, wherein the plastic material is low-density polyethylene (LDPE).

15. The device of claim 14, wherein the plastic body has a thickness of about ⅛ inch.

16. The device of claim 1, wherein the body of the device has a stiffness and flexibility such that, with the body held at the sides, when a load of ten pounds is applied at the center of the bottom, the center of the front edge will dip downwardly about 3 to 3½ inches.

17. The device of claim 1, wherein the body of the device has a stiffness and flexibility such that, with the body held at the sides, when a load of twenty pounds is applied at the center of the bottom, the center of the front edge will dip downwardly about 4 to 5 inches.

18. The device of claim 1, wherein the flexible plastic material of the body has a flexural modulus of about 42,000 to 50,000 psi.

19. The device of claim 1, wherein the flexible plastic material of the body has a characteristic of returning the bottom to essentially flat configuration after the bottom has been forced to a curved, downwardly tipping configuration for pouring materials from the device.

20. The device of claim 1, wherein the handles at centers are positioned no more than about 11 inches from the rear wall of the body.

21. The device of claim 1, wherein the handles at center are positioned at locations 25% to 40% of the body's length from the rear wall of the body.

* * * * *